US009688494B2

(12) United States Patent
Floding et al.

(10) Patent No.: US 9,688,494 B2
(45) Date of Patent: Jun. 27, 2017

(54) APPARATUS AND METHODS FOR PRODUCING SHRINK-WRAP PACKAGING

(75) Inventors: Daniel Leonard Floding, Alexandria, MN (US); Irvan Leo Pazdernik, Alexandria, MN (US); Kyle Nelson, New Folden, MN (US); Richard Willard Lukanen, Jr., Alexandria, MN (US)

(73) Assignee: Douglas Machine Inc., Alexandria, MN (US)

( * ) Notice: Subject to any disclaimer, the term of this patent is extended or adjusted under 35 U.S.C. 154(b) by 685 days.

(21) Appl. No.: 13/642,967

(22) PCT Filed: Apr. 22, 2011

(86) PCT No.: PCT/US2011/033524

§ 371 (c)(1), (2), (4) Date: Nov. 2, 2012

(87) PCT Pub. No.: WO2011/133832

PCT Pub. Date: Oct. 27, 2011

(65) Prior Publication Data

US 2013/0036712 A1 Feb. 14, 2013

Related U.S. Application Data

(60) Provisional application No. 61/327,479, filed on Apr. 23, 2010.

(51) Int. Cl.
*B65H 5/24* (2006.01)
*B65H 5/22* (2006.01)
(Continued)

(52) U.S. Cl.
CPC ..... *B65H 5/224* (2013.01); *B26D 7/08* (2013.01); *B26D 7/20* (2013.01); *B26D 7/2614* (2013.01);
(Continued)

(58) Field of Classification Search
CPC ..... B65G 15/58; Y10T 83/0443; Y10T 83/0448; Y10T 83/0453; Y10T 83/2006;
(Continued)

(56) References Cited

U.S. PATENT DOCUMENTS 3,477,558 A 11/1969 Fleischauer
3,676,979 A 7/1972 Schuette
(Continued)

*Primary Examiner* — Phong Nguyen
(74) *Attorney, Agent, or Firm* — Alan D. Kamrath; Kamrath IP Lawfirm, P.A.

(57) ABSTRACT

A vacuum table (18) includes an introduction section (102) in fluid communication with a vacuum chamber (120) and a compartment (139) dividable by an adjustment partition (156) into primary and secondary vacuum chambers (139*a*, 139*b*). Adjustment plates (130) having adjustment apertures (138) are positionable over apertures (128) of the conveying surface (100) of the vacuum table (18) generally perpendicular to the conveying direction. Film (20) extends from between the nip of pinch rollers (12, 13) to the conveying surface (100) and is tensioned therebetween to be cut in excess of 105 cuts per minute by a servo motor controlled rotary cutter (30) which stops after each cut. The shaft (32) of the rotary cutter (30) includes a bore (310) extending from the idle end to provide servo-control loop stability.

32 Claims, 8 Drawing Sheets

(51) Int. Cl.

| | |
|---|---|
| ***B26D 7/08*** | (2006.01) |
| ***B26D 7/20*** | (2006.01) |
| ***B26D 7/26*** | (2006.01) |
| ***B65B 61/08*** | (2006.01) |
| ***B65H 35/08*** | (2006.01) |
| ***B65H 7/18*** | (2006.01) |
| *B26D 1/36* | (2006.01) |
| *B26D 1/38* | (2006.01) |
| *B26D 7/06* | (2006.01) |

(52) U.S. Cl.
CPC ..... *B65B 61/08* (2013.01); *B65H 5/222* (2013.01); *B65H 7/18* (2013.01); *B65H 35/08* (2013.01); *B26D 1/365* (2013.01); *B26D 1/385* (2013.01); *B26D 7/0625* (2013.01); *B65H 2406/3124* (2013.01); *B65H 2406/362* (2013.01); *B65H 2511/10* (2013.01); *B65H 2511/514* (2013.01); *B65H 2701/1752* (2013.01); *Y10T 83/04* (2015.04); *Y10T 83/207* (2015.04); *Y10T 83/9372* (2015.04)

(58) Field of Classification Search
CPC ..... Y10T 83/207; Y10T 83/2092; Y10T 83/2192; Y10T 83/364; B65H 5/224; B65H 7/16; B65H 7/18; B65H 29/242; B65H 2406/3124; B65H 2406/322; B65H 2406/3221; B65H 2406/36; B65H 2406/362; B65H 5/2248; B65H 5/222; B65H 35/08; B65H 2511/10; B65H 2511/514; B65H 2701/1752; B65H 29/05; B26D 7/20; B26D 7/08; B26D 7/2614; B26D 7/0625; B26D 1/365; B26D 1/385; B65B 61/08
USPC ..... 198/689.1; 271/276, 198, 197
See application file for complete search history.

(56) References Cited

U.S. PATENT DOCUMENTS

| | | | | |
|---|---|---|---|---|
| 3,741,116 | A | 6/1973 | Green et al. | |
| 3,848,327 | A | 11/1974 | Gerber et al. | |
| 3,889,801 | A | 6/1975 | Boyer | |
| 3,969,029 | A | 7/1976 | Schaeffler | |
| 4,096,941 | A | 6/1978 | Tokuno | |
| 4,555,013 | A | 11/1985 | Franklin | |
| 4,825,255 | A | 4/1989 | Iaia, Jr. et al. | |
| 5,061,133 | A | 10/1991 | May et al. | |
| 5,139,253 | A | 8/1992 | Bohme et al. | |
| 5,380,118 | A | 1/1995 | Stahlecker et al. | |
| 5,524,420 | A | 6/1996 | Ikuta | |
| 5,699,707 | A | 12/1997 | Campbell, Jr. | |
| 5,730,440 | A * | 3/1998 | Motooka | 271/276 |
| 5,752,365 | A | 5/1998 | Johnson et al. | |
| 5,771,662 | A | 6/1998 | Struges et al. | |
| 5,779,236 | A | 7/1998 | Duncan, Jr. et al. | |
| 6,443,443 | B1 | 9/2002 | Hirth et al. | |
| 6,615,476 | B1 | 9/2003 | Yamanaka et al. | |
| 6,746,015 | B2 | 6/2004 | Lehmann | |
| 7,032,360 | B2 | 4/2006 | Rutten et al. | |
| RE39,441 | E | 12/2006 | Wotton et al. | |
| 7,207,558 | B2 * | 4/2007 | Edinger | 271/197 |
| 7,412,866 | B2 | 8/2008 | Jahani et al. | |
| 7,578,629 | B2 * | 8/2009 | Kruijt | 400/645 |
| 8,505,890 | B2 * | 8/2013 | Toya | 269/21 |
| 8,561,511 | B2 * | 10/2013 | Downing et al. | 83/100 |
| 2004/0232611 | A1 * | 11/2004 | Fujioka et al. | 271/276 |
| 2005/0109588 | A1 * | 5/2005 | Gariglio | 198/817 |
| 2006/0075861 | A1 | 4/2006 | Flooding et al. | |
| 2006/0096249 | A1 | 5/2006 | Duterte et al. | |
| 2006/0254881 | A1 | 11/2006 | Furthmueller et al. | |
| 2008/0060406 | A1 | 3/2008 | Yamanaka et al. | |
| 2009/0139368 | A1 | 6/2009 | Mayer | |
| 2009/0174138 | A1 * | 7/2009 | Abe | 271/276 |
| 2010/0068428 | A1 | 3/2010 | Derse | |

* cited by examiner

| | OD [in] | ID 1 [in] | ID 2 [in] | D3 [in] | L1 [in] | L2 [in] | L3 [in] | L [in] | $\delta$ [$10^{-3}$ in] | $\omega_c$ [KHz] | $\omega_n$ [KHz] | Power @ $\omega_n$ |
|---|---|---|---|---|---|---|---|---|---|---|---|---|
| 1) | 1.750 | — | — | — | — | — | — | 39.37 | 1.58 | 4.23 | 0.753 | 11.01 |
| 2) | 1.750 | 1.625 | — | — | THRU | — | — | 39.37 | 0.84 | 5.78 | 0.753 | 0.72 |
| 3) | 1.750 | 1.625 | — | — | L/2 | | — | 39.37 | 5.37 | 2.29 | 1.038 | 3.19 |
| 4) | 1.750 | 1.625 | 1.250 | — | L/2 | L/4 | — | 39.37 | 4.79 | 2.43 | 1.035 | 1.96 |
| 5) | 1.750 | 1.625 | 1.250 | 0.875 | L/4 | L/4 | L/4 | 39.37 | 2.99 | 3.08 | 0.960 | 5.04 |

FIG. 8

APPARATUS AND METHODS FOR PRODUCING SHRINK-WRAP PACKAGING

BACKGROUND

Shrink-wrap packaging and apparatus and methods for producing the same and particularly to shrink-wrap packaging and apparatus and methods for feeding and cutting a shrink-wrap film utilized in producing the shrink-wrap packaging are shown and described.

In the packaging industry, the need for faster production lines running at maximum efficiency is at an all time high. Manufacturers are operating 24 hours per day, 7 days per week just to maintain consumer product demands. Obviously, the machinery produced to operate on these packaging lines need to keep pace, if not, exceed the expectations and demands of the end users. Also, more manufacturers are turning to shrink-wrap packaging due to the lower cost of plastic as compared to corrugated boxes along with the ability to use full color graphics to produce aesthetically pleasing packages in an attempt to differentiate themselves from competitors.

In shrink-wrapping, a single sheet of shrink-wrap film is wrapped around the product and into a tubular form. The overlapping lateral edges are located beneath the product and are sealed or otherwise joined together. During shrinking in a heat tunnel, the longitudinal edges of the shrink-wrap film collapse against the ends of the product creating bull's eye-type openings.

U.S. Pat. Nos. 5,771,662 and 7,032,360 represented a major advance in the field of feeding, perforating and cutting a shrink-wrap film. Specifically, methods and apparatus are disclosed in U.S. Pat. Nos. 5,771,662 and 7,032,360 for forming a single sheet of film from a web of film and connected to the web of film by tie strips to maintain tension on the web of film after cutting, with the tie strips later being broken to separate the single sheet of film from the web of film.

The speeds of shrink-wrap packaging machinery were limited by film cutter technology that could accurately and consistently cut the film at cycle rates high enough to keep pace with production. No devices hold or grasp the film while cutting so manufacturers encounter many challenges when cutting film at high cycle rates. These challenges include twisting of shafts when run at high speeds, torsional shaft oscillations causing the cutter knife to miss film cuts, the time required for the shaft material to adequately dampen out any torsional oscillations (vibrations) before the next cut event occurs, a "jump roping" effect where even a perfectly balanced shaft begins to deflect laterally when turned at a particular resonant rpm causing the knife to hit upon the support deck because the shaft is jump roping, and reduced bearing life.

Particularly, conventional cutter shafts had deficiencies which limited its cycle rate to approximately 105 cuts per minute. Unwieldy shaft twist resulted when attempting to run at speeds over 105 cuts per minute. Frequency and magnitude of the torsional shaft oscillations made high performance servo loop control difficult, if not impossible. Thus, servo gains could not be set high enough to achieve the quality of motion precision for high speed applications. When servo gains are turned down to accommodate inferior shaft designs, the shaft might not cut where desired because the servo cannot adequately reproduce the commanded position. Furthermore, the knife can demonstrate trajectory over shoot and subsequent oscillations as it tries to bring the knife to rest at the stop location. If the overshoot is excessive, it causes the film trajectory to deviate from the desired film path. The film trajectory is likely deviated due to air flow disturbance caused by the knife overshoot. The time required for the shaft material to adequately dampen out any torsioinal oscillations before the next cut event occurs was too long. If the shaft still exhibited torsion motion, this can adversely affect the next cut performance due to the existence of this unwanted energy which must be overcome. Shaft rpm was limited, because the shaft would demonstrate the phenomenon known as "shaft rotational critical frequency". This phenomenon is where the shaft begins to deflect laterally when turned at a particular resonant rpm, even if the shaft is perfectly balanced. The lateral deflection of the shaft causes what looks like a jump rope effect. The jump rope effect is undesirable as it causes the periphery of the knife to deviate from the commanded trajectory, e.g. the knife would hit upon the support deck.

Thus, there is a continuing need to improve the function, to reduce maintenance, to provide enhanced adjustability and to reduce the number and complexity of components in an apparatus for producing shrink-wrap packaging and to overcome the challenges in the field of film cutting and handling.

SUMMARY

These needs and other problems in the field of shrink-wrapping are solved by providing novel methods and apparatus for handling an element such as a film and, in particular, novel shrink-wrap packaging and apparatus and methods for producing the same.

Novel methods and apparatus maintain tension on the web of film while a sheet is cut therefrom by rapidly rotating a rotary cutter to engage the film extending from a nip of pinch rollers and a conveying surface of a vacuum table having sufficient vacuum to tension the film adjacent to the cut-off knife.

In another aspect, a bore extends from the idle end of the shaft towards the servo motor driven end for a length sufficient to provide servo-control loop stability to allow cutting speeds in excess of 105 cuts per minute. The bore can include portions of decreasing internal diameters, with the lengths and internal diameters of the portions being designed utilizing mathematical equations.

In still other aspects, an adjustment plate is adjustably positioned perpendicular to the conveying direction of a carrier moving over the top conveying surface of a vacuum chamber for blocking air apertures of the top conveying surface.

In further aspects, a carrier moves over conveying surfaces of first and second vacuum chambers in a conveying direction with the amount of vacuum being operationally different in the first and second vacuum chambers.

Such novel methods and apparatus insure that the web of film follows the desired path when a sheet is cut therefrom.

Such novel methods and apparatus prevent snap back and curling of the web of film while a sheet is cut therefrom.

Such novel methods and apparatus do not require devices which hold the film across the cut or which grasp the leading edge of the web of film.

Illustrative embodiments will become clearer in light of the following detailed description in connection with the drawings.

DESCRIPTION OF DRAWINGS

The illustrative embodiments may best be described by reference to the accompanying drawings where:

FIG. 8 shows a table showing characteristics of the shaft designs of FIG. 6, where $W_c$ is the shaft critical speed, $W_n$ is the lowest frequency mode of torsional vibration at the driven end, and P is the periodogram power of the $W_n$ frequency.

Figure 1:
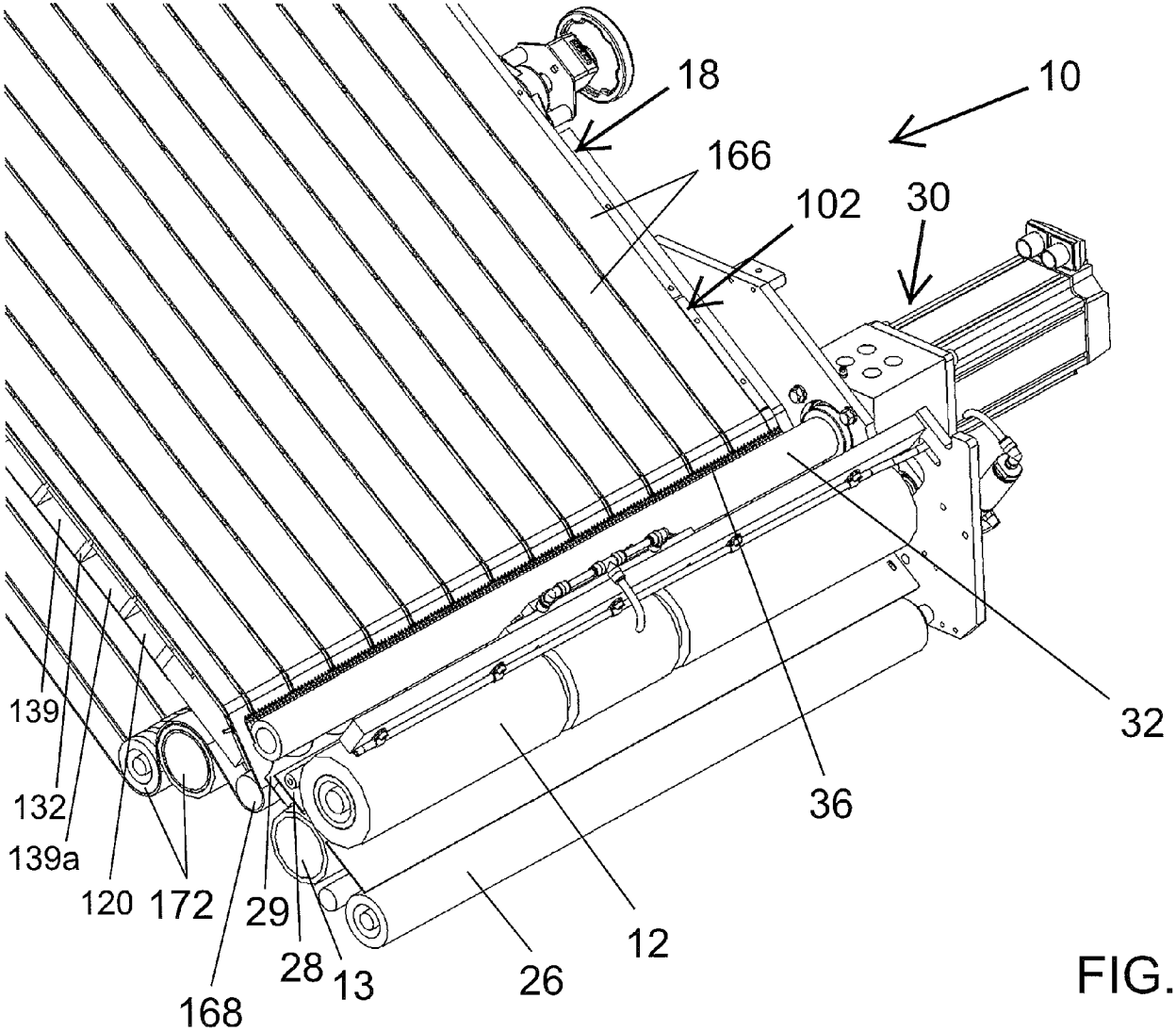
FIG. 1 shows a partial, perspective view of an apparatus for producing shrink-wrap packaging, with portions broken away to show constructional detail.
Figure 2:
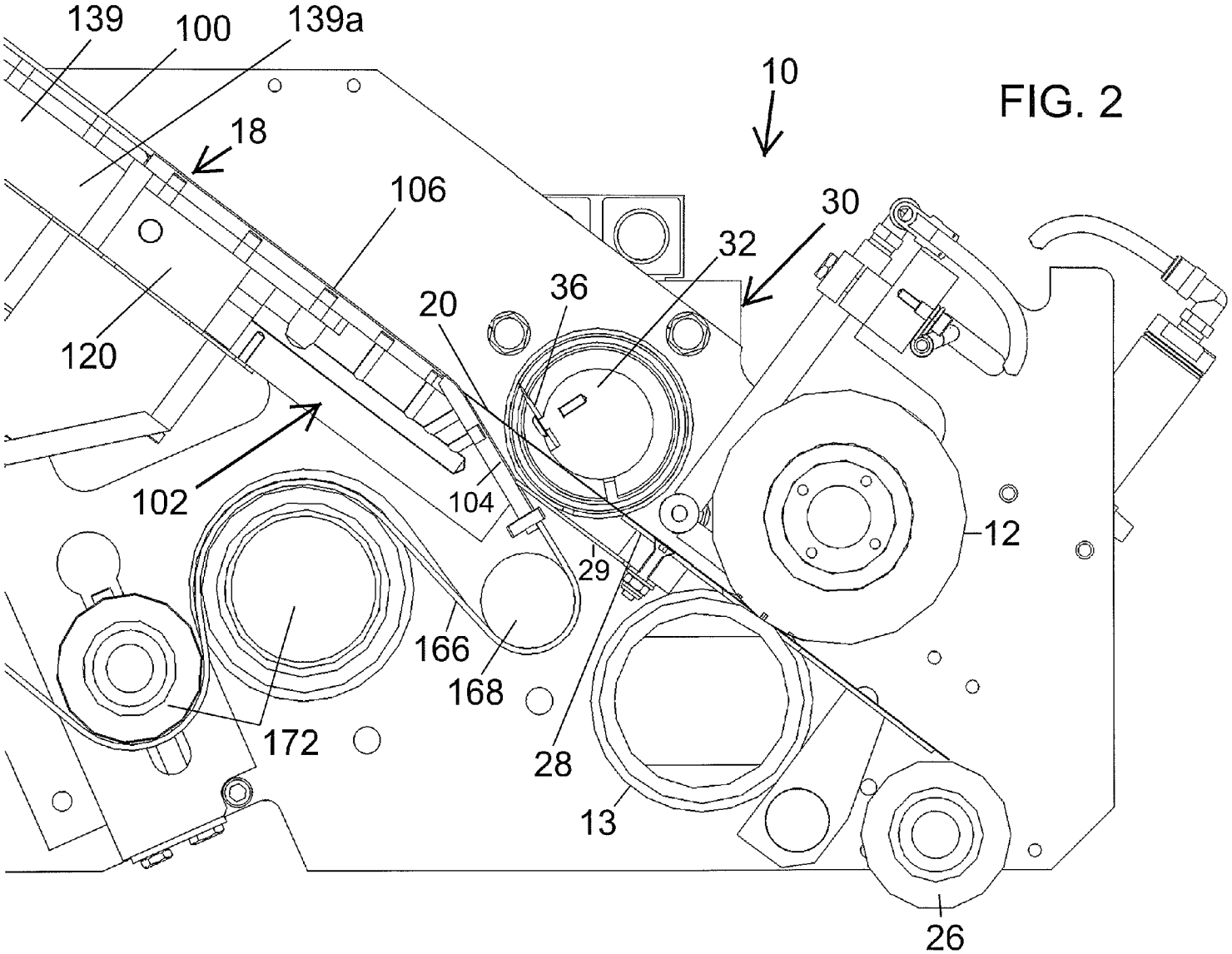
FIG. 2 shows a partial, side view of the apparatus of FIG. 1 with portions broken away to show constructional detail.
Figure 3:
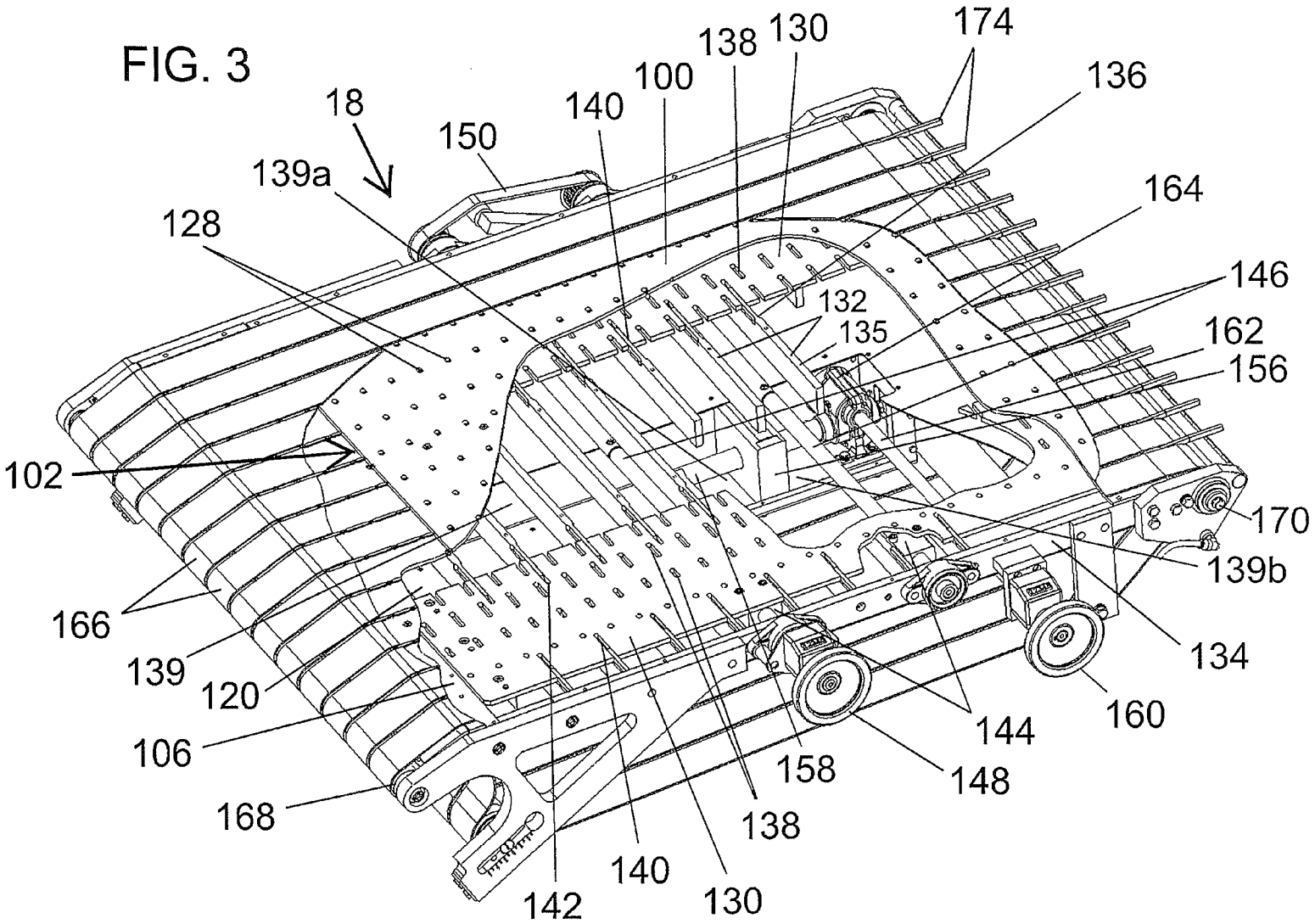
FIG. 3 shows a partial, perspective view of the apparatus of FIG. 1 with portions broken away to show constructional detail.
Figure 4:
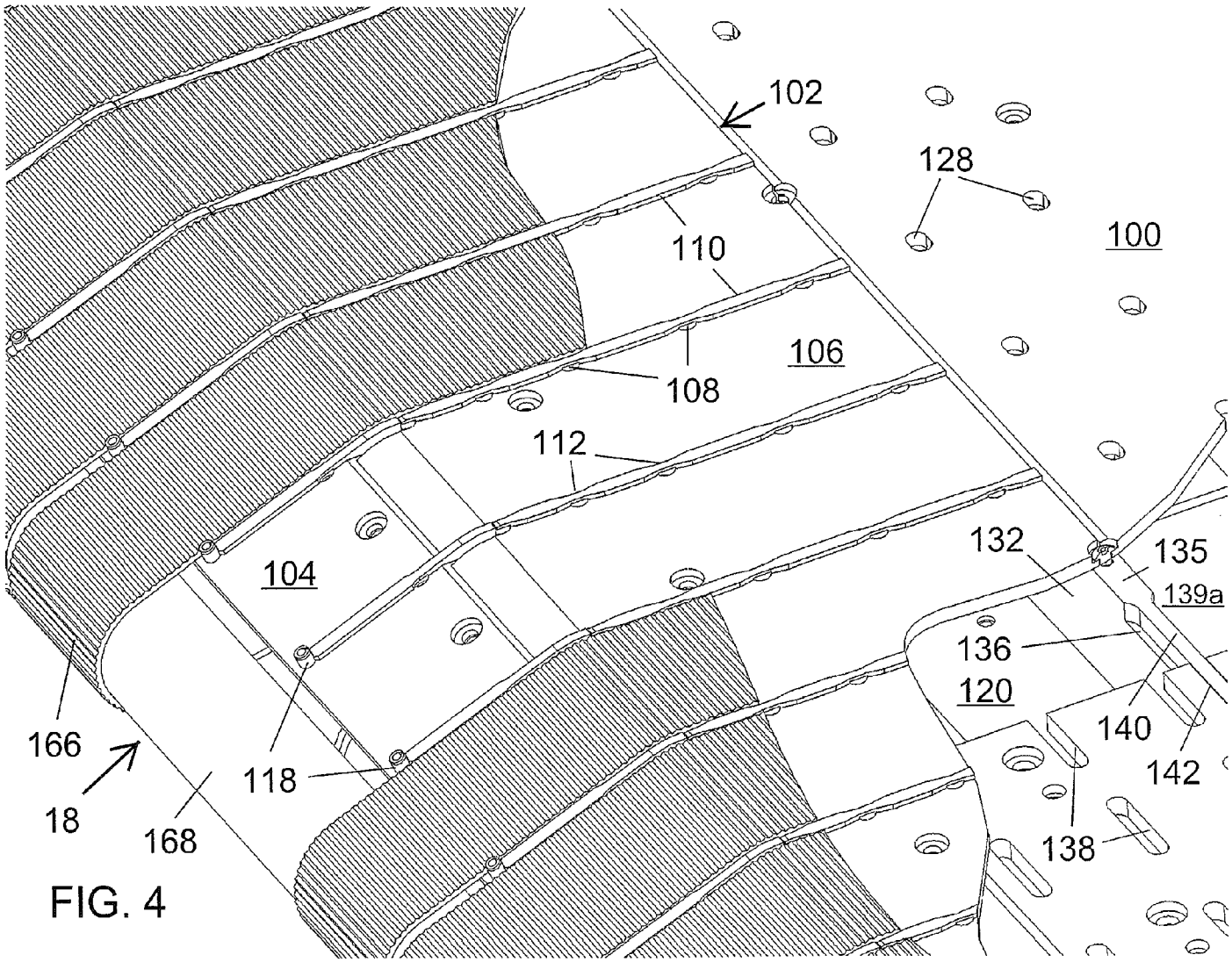
FIG. 4 shows a partial, perspective view of the apparatus of FIG. 1 with portions broken away to show constructional detail.
Figure 5:
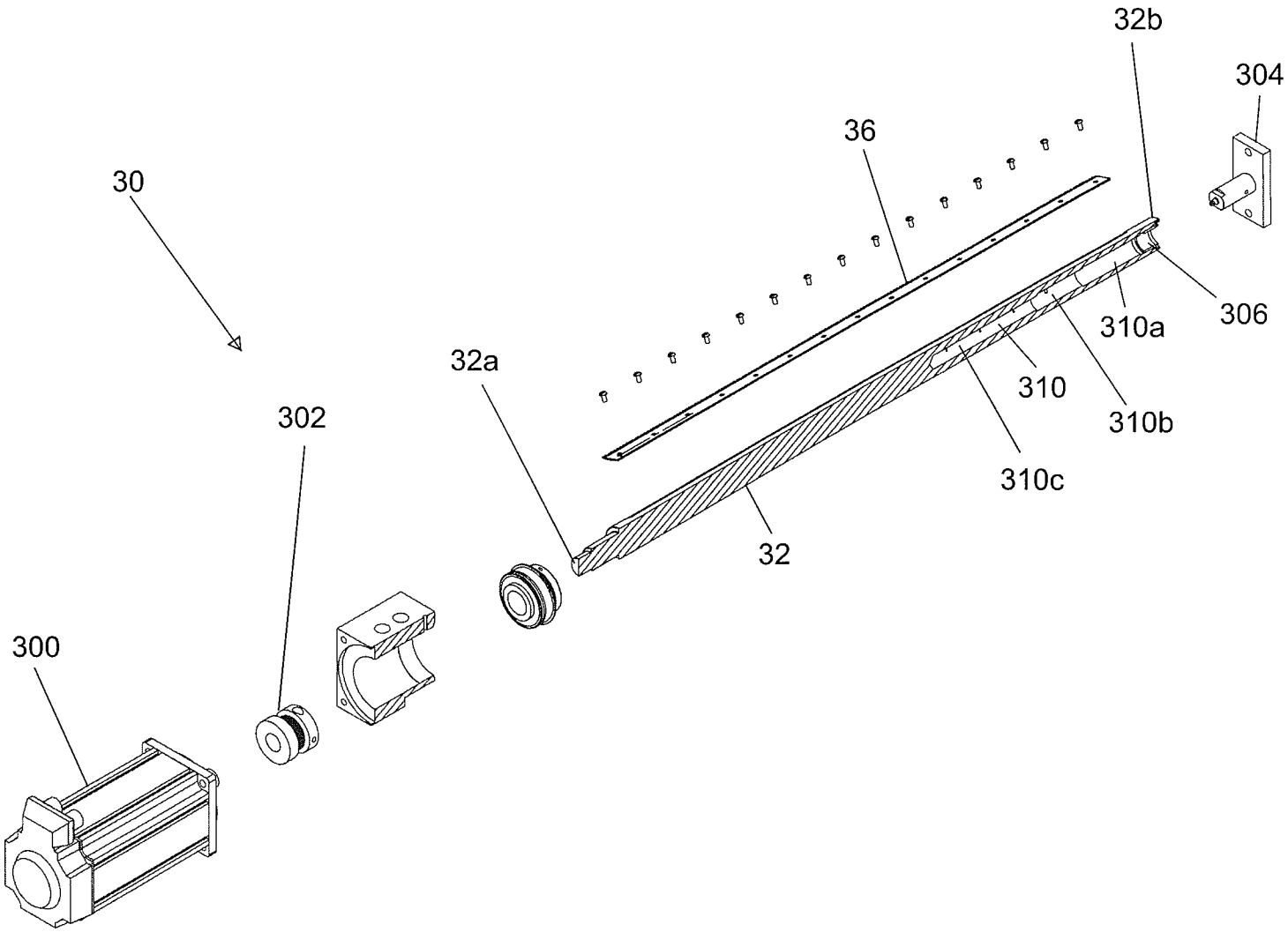
FIG. 5 shows a partial, exploded, perspective view of the apparatus of FIG. 1 with portions broken away to show constructional detail.

All figures are drawn for ease of explanation of the basic teachings only; the extensions of the figures with respect to number, position, relationship, and dimensions of the parts to form the illustrative embodiments will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "width", "length", "end", "side", "horizontal", "vertical", "axial", "radial", "longitudinal", "lateral", and similar terms are used herein, it should be understood that these terms have reference only to the structure shown in the drawings as it would appear to a person viewing the drawings and are utilized only to facilitate describing the illustrative embodiments.

DESCRIPTION OF THE ILLUSTRATIVE EMBODIMENTS

Apparatus for feeding and cutting a shrink-wrap film is shown in the drawings and generally designated 10. Generally, apparatus 10 includes a pair of pinch rollers 12 and 13 having parallel spaced axes. In particular, the outer peripheries of rollers 12 and 13 abut. Apparatus 10 further includes a vacuum table 18 including a top conveying surface 100 extending from adjacent to the nip of rollers 12 and 13. The top conveying surface 100 lies in the same plane as the plane tangent to the abutments of rollers 12 and 13. In the form shown, the plane of the top conveying surface 100 of vacuum table 18 and the plane tangent to the abutments of rollers 12 and 13 extend at an acute angle to the horizontal in the order of 40°, with the height of vacuum table 18 increasing with increasing spacing from rollers 12 and 13.

Film 20 is delivered from a film roll through a plurality of dancer bars which create film tension. From the dancer bars, film 20 extends to an idler roller 26. Film 20 extends tangentially from the periphery of idler roller 26 in the plane tangent to the abutments of rollers 12 and 13 and top conveying surface 100. From idler roller 26, film 20 extends through the abutment nip of rollers 12 and 13 and then moves in a conveying direction onto top conveying surface 100 of vacuum table 18. Thus, film 20 from roller 26 to and including top conveying surface 100 of vacuum table 18 lies in a single plane. After the abutment nip of rollers 12 and 13 and prior to vacuum table 18, film 20 passes over a deck 28 having a top surface lying generally in the same plane as the plane of top conveying surface 100 of vacuum table 18 and the plane tangent to the abutments of rollers 12 and 13. In the form shown, deck 28 includes a linearly straight edge that does not include serrations. A catch deck 29 is located below, spaced from and parallel to deck 28.

A rotary cutter 30 is positioned between the pair of pinch rollers 12 and 13 and vacuum table 18. In particular, cutter 30 includes a shaft 32 formed of aluminum, carbon fiber, titanium, composites thereof or the like. Shaft 30 is rotatable by a servo motor 300 about an axis parallel to and spaced from the axes of rollers 12 and 13. In the form shown, servo motor 300 is coupled to a first end 32*a* of shaft 32 with a torsionally rigid servo class coupling/bearing 302. The second end 32*b* of shaft 32 is suitably rotatably supported such as by an internal bearing system 304 received in a counterbore 306 extending inwardly of second end 32*b*. Thus, shaft 32 is supported by two bearings in a simply supported fashion. However, it should be appreciated that shaft 32 can be rotatably connected to servo motor 300 and/or rotatably supported in other manners. As an example, first end 32*a* could be counterbored to accept the shaft of servo motor 300 and to be squeezed thereon such as by a radial clamping collar. Thus, servo motor 300 could be mounted to a flexible plate for ease of alignment, as well as reducing inertia, costs and space requirements.

Cutter 30 further includes a cut-off knife 36 mounted to one side of shaft 32 and having a laterally extending cutting edge of a size at least equal to and preferably larger than the spacing between the longitudinal edges of the web of film 20. The cutting edge of knife 36 extends radially beyond shaft 32 a distance greater than the radial spacing of film 20 from the axis of shaft 32 and cutter 30. In the form shown, the cutting edge of knife 36 is serrated with triangular-shaped, equal-size teeth, with knife 36 being sharpened on all cutting surfaces and in particular the valley, tooth and the surface of the tooth in the form shown. Catch deck 29 is spaced from the axis of shaft 32 generally equal to the maximum spacing of knife 36 from the axis.

Vacuum table 18 further includes an introduction section 102 including a conveying surface including a first surface 104 and a second surface 106 arranged at an obtuse angle in the order of 160°, with second surface 106 extending linearly and contiguously with top conveying surface 100. Catch deck 29 terminates in a close, generally abutting relation with first surface 104 of introduction section 102 and spaced from second surface 106. The conveying surface of section 102 generally includes a plurality of air apertures 108 arranged in a right array of rows and columns. A plurality of sidewalls 110 extend in section 102 in a spaced parallel arrangement over the columns of air apertures 108. Air apertures 108 have an extent parallel to the rows greater than sidewalls 110 and in the form shown, first and recesses 112 extend from opposite sides of each sidewall 110 perpendicular to the conveying direction and at locations corresponding to and aligned with air apertures 108. Guides 118 are located in front of each sidewall 110 and have an extent parallel to the rows of air apertures 108 generally equal to sidewalls 110. Air apertures 108 of introduction section 102 are in fluid communication with a vacuum chamber 120.

Top conveying surface 100 generally includes a plurality of air apertures 128 arranged in a right array of rows of columns with the columns of air apertures 128 aligned with the columns of air apertures 108. In the form shown, air apertures 128 are generally oval shaped with the major axis parallel to the rows and perpendicular to the conveying direction.

Vacuum table 18 further includes first and second adjustment plates 130 slideable beneath top conveying surface 100 and a trailing portion of second surface 106 and in a generally fluid sealing arrangement. First and second adjustment plates 130 each have a right array of air adjustment apertures 138 arranged in rows and columns and each have a width parallel to the rows which is less than 50% of the width of top conveying surface 100. Specifically, in the form shown, vacuum table 18 includes a plurality of spaced cross members 132 extending between the spaced and parallel sides 134 of a compartment 139 of vacuum table 18 and having upper surfaces 135 abutting with top conveying surface 100. Cross members 132 include an elongated depression 136 extending from each side 134 of a depth generally equal to the thickness of adjustment plates 130 and having a width greater than adjustment plates 130. First and second protrusions 140 extend in depressions 136 to a height equal to the upper surfaces 135 and with a thickness parallel to columns of air apertures 108, 128, and 138 less than cross members 132. In the form shown, protrusions 140 are elongated parallel to rows of air apertures 108, 128 and 138. First and second adjustment plates 130 include slots 142 extending parallel to the adjustment direction and slideably receiving protrusions 140 and elongated parallel to the rows of air apertures 108, 128 and 138 greater than protrusions 140. Air apertures 138 are arranged in a series of increasing lengths in the adjustment direction from sides 134 inwardly.

Suitable provisions can be provided to adjust the positioning of adjustment plates 130 in an adjustment direction perpendicular to the conveying direction and specifically in the form shown to adjust spacing of adjustment plates 130 in the adjustment direction including, but not limited to, manually, mechanically, automatically or the like. In an illustrative form, adjustment plates 130 are adjustable manually. Specifically, in the form shown, each adjustment plate 130 is mounted to first and second blocks 144 in gearing relation to first and second shafts 146. At least one of shafts 146 can be rotated such as by a manual turn wheel 148, with shafts 146 being driven together such as by a belt drive 150 in the form shown. Thus, adjustment plates 130 will move towards each other by turning wheel 148 in one direction and will move away from each other when turning wheel 148 in the opposite direction. Depending upon the location of adjustment plate 130 relative to top conveying surface 100, air apertures 138 will be aligned with different air apertures 128. Any aperture 128 which is not aligned with air aperture 138 will be closed to fluid flow by adjustment plate 130.

Vacuum table 18 further includes an adjustment partition 156 moveable in a direction parallel to the columns of air apertures 108, 128 and 138. Suitable provisions can be provided to adjust the location of adjustment partition 156 including, but not limited to, manually, mechanically, automatically or the like. In an illustrative form, adjustment partition 156 is adjustable manually. Particularly, in the form shown, adjustment partition 156 is in gearing relation to a third shaft 158. Shaft 158 can be rotated such as by a manual turn wheel 160 on a shaft 162 in gearing relation with shaft 158 such as by a right angle drive 164. Thus, by rotating manual turn wheel 160, adjustment partition 156 can abut with and be in a sealing relation with one of cross member 132.

It should be appreciated that adjustment partition 156 in sealing relation with one of cross member 132 divides compartment 139 into primary and secondary vacuum chambers 139*a* and 139*b* which can be independently under different vacuum pressures from each other and from vacuum chamber 120. In the form shown, vacuum chamber 139*a* is at a constant vacuum pressure. Introduction vacuum chamber 120 is at a variable vacuum pressure having a maximum pressure greater than that of vacuum chamber 139*a*. Vacuum chamber 139*b* is at a variable vacuum pressure having a maximum pressure generally equal to that of vacuum chamber 139*a*.

Vacuum table 18 further includes carrier such as in the form of a plurality of endless belts 166 extending around end rollers 168 and 170 and moving in the conveying direction over introduction section 102 and top conveying surface 100. Each belt 166 is located between adjacent sidewalls 110 in introduction section 102. The carrier in the form of belts 166 includes an upper surface for abutment with an element such as film 20 to be conveyed and a lower surface for abutment with surfaces 104 and 106 of introduction section 102 and top conveying surface 100. Air communication is provided between film 20 and vacuum chambers 120, 139*a* and 139*b* through the plurality of air apertures 108 and 128 by aligning air apertures 108 and 128 with the spacings of the plurality of belts 166 in the adjustment direction of adjustment plates 130. In the form shown, belts 166 do not include a flat upper surface and in the form shown are of a saw tooth style in the conveying direction. In alternate forms, the upper surface of belts 166 could be of a raised bottom style, cross hatched, or include any provisions which allow fluid communication between belts 166 and film 20. Belts 166 can pass over rollers 172 for spacing belts 166 below introduction section 102 and top conveying surface 104 and for providing tension between rollers 168 and 170. Spaced and parallel fingers 174 can extend over end roller 170 and a portion of top conveying surface 100 and have a height generally equal to belts 166, with fingers 174 aligned with sidewalls 110. Sidewalls 110 of introduction section 102 have heights generally equal to distances between the upper and lower surfaces belts 166, with air apertures 108 having an extent in the adjustment direction and perpendicular to the conveying direction greater than sidewalls 110. In the form shown, top conveying surface 100 is intermediate the carrier in the form of the plurality of belts 166 and adjustment plates 130.

In the form shown, rotary cutter 30 achieves servo-control loop stability and desired knife performance required for cutting of film 20 at high speeds. Specifically, the desired response of the servo system will be that servo motor 300 can induce the full motor torque capacity into shaft 32 with a minimum of position error, settling time, and shaft twist. Also of importance is the rotational critical frequency of shaft 32. The rotational critical frequency corresponds to the rotational speed (rpm) of shaft 32 at which shaft 32 will begin to undergo lateral jump rope oscillations. If shaft 32 is rotated at the critical shaft frequency, the lateral vibration created can cause failure of the support bearings and the servo coupling/bearing 302. The next important mode of vibration is that of torsion. When servo motor 300 imparts maximum acceleration at end 32*a* of shaft 32, end 32*b* will tend to wind-up. Shaft 32 is then set into torsion oscillations along its length. The shape of shaft 32*b* is modified to "tune" shaft 32 such that the modes of torsion frequencies are in the desired range and energies desired. Particularly, shaft 32 may include an internal, multiple step, bore 310 extending from end 32*b* of shaft 32 towards but spaced from end 32*a*. Specifically, bore 310 in the form shown includes first, second and third portions 310*a*, 310*b* and 310*c* and, in a form shown as #5 in FIG. 6, having generally equal lengths L1, L2, L3. Third portion 310*c* is spaced a distance from end 32*a* generally equally to lengths L1, L2 and L3. The internal diameter ID3 of portion 310*c* is less than the internal diameter ID2 of portion 310*b* which is less than the internal diameter ID1 of portion 310*a*. In the form shown, internal diameter ID1 is approximately 93% of outer diameter OD, internal diameter ID2 is approximately 71.5% of outer diameter OD, and internal diameter ID3 is approximately 50% of outer diameter OD.

Figure 6:
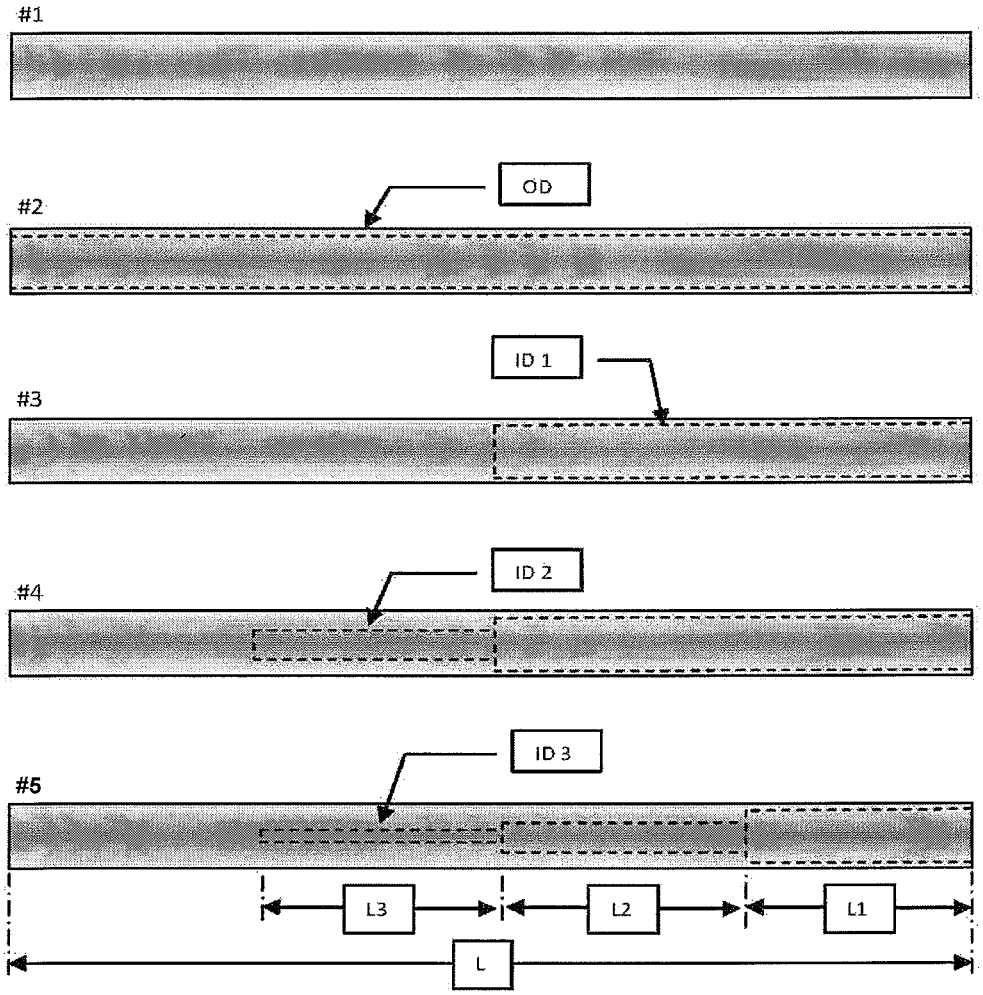
FIG. 6 shows a diagrammatic view of alternate shaft designs of the apparatus as shown in FIG. 5.

However, for assisting an understanding that bore 310 is not limited to three portions 310*a*, 310*b* and 310*c*, further explanation will be given. Specifically, each change to the shaft dimensions produces a new critical shaft frequency and new modes of torsion oscillations. To demonstrate how the torsional frequency, lateral shaft sag deflection, and critical frequency of the shaft change when the shaft's dimensions are changed, five shafts of different design are shown in FIG. 6, all having common length L, outside diameter OD, and material, but each being more complex than the next. Specifically, the first shaft design is simply a solid shaft of outside diameter OD and length L. The second shaft has the same outside diameter OD but a uniform inside diameter ID1 to fashion a thin wall tube. The three further shaft designs include a single step bore, double step bore and triple step bore.

Figure 7:
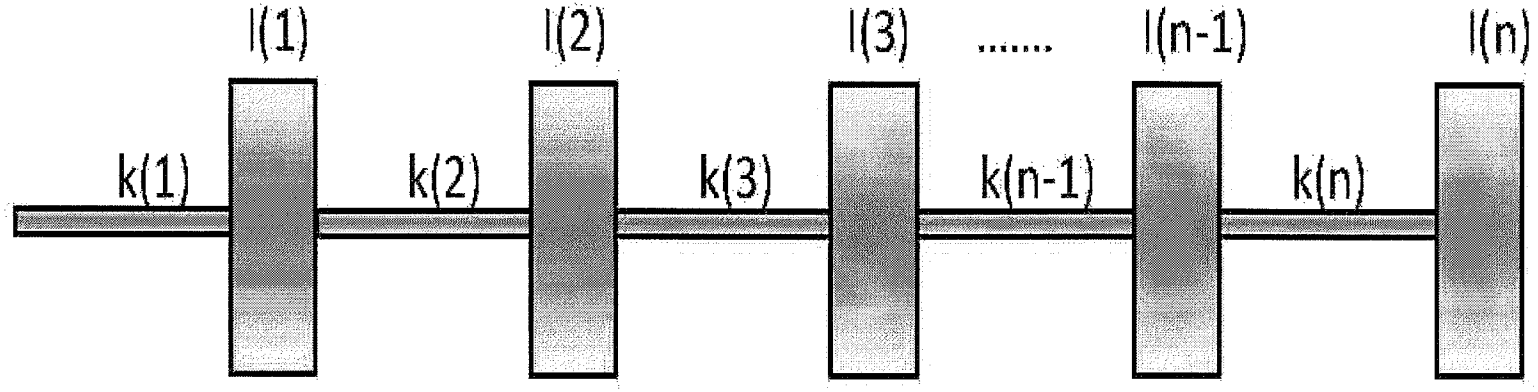
FIG. 7 shows a diagrammatic view of a system model of the shaft designs of the apparatus as shown in FIG. 5.

If a quick twist was given to end 32*a* of each of these shafts, a twist is developed in each shaft. Furthermore, as each shaft is simply supported, there is some amount of sag due to gravity. It is known that a tube bends less and has higher rotation critical rpm than a solid shaft. Further, it is known that frequency of torsional vibration $W_n$ increases with decreasing inertia I. Thus, with an internal bore, a tube will have decreasing inertia I and increasing frequency $W_n$, which is desired. Shaft 32 can be viewed as a system of n discrete oscillators of inertia I and springs, each representing a portion of shaft 32. The diagram of such systems is shown in FIG. 7. Each section of the system of FIG. 7 can have different spring constants k(j). Each segment of the system of FIG. 7 will have its own inertia I. The internal bore dimensions of each finite shaft segment can be changed, and each will be coupled to the next by the springs that connect them. By letting $n \rightarrow \infty$, the desired shape of the continuous taper can be determined. The solution to the n coupled torsion pendulum is solved via Lagrange's equation of energies.

Considering that frequency $W_n$ increase with decreasing inertia I, it is realized an internal taper causes the system of coupled oscillators to result in higher Eigenfrequencies, which is desired. When such systems are simple as in the case of the uniform solid rod and tube, the Eigenfrequencies are few. As the shaft has a number of internal step bores of increasing diameter, a higher number of Eigenfrequencies will be developed. Interest should be in the lowest of these values as they will have the greatest affect on the servo loop response. It will also be the lowest frequencies that must be known so that proper digital filter can be applied to the controller. Frequencies of less than 500 Hz are about as low as should be accepted for the cutter performance. From the computed results of these finite stepped bores, it can be inferred that the n-systems of stepped bores (which results in a continuous taper) will produce similar results but of higher quality of characteristics for parameters $W_c$ and $W_n$. Using a discrete Fourier transform analysis to identify the Eigenfrequencies developed in the complex shaft when systems are modeled via simulation software or laboratory instrumentation is one manner to solve the n-system oscillator when n is large. The table of FIG. 8 sets forth the results for the five shaft designs of FIG. 6.

The results of the Table of FIG. 8 indicate that a triple step shaft design of the form shown and furthermore a n-step taper will be the best shaft, because frequency $W_n$ will be the largest value set subject to parameter $W_c$ being greater than the maximum required rpm of servo motor 300 by the motion required to cut film. If n is taken to infinity a non step bore but a continuous bore will result where the internal radius r(x) goes from a step function to a continuous function of r(x). To achieve even better solutions, computer programs could be created to automate the computations such that an optimization method can be applied. The choice of depth of the bore and the internal radius will be the iteration variables in the optimization process. The number of steps is not as important but should be fairly high so as to approximate a continuous r(x) function. The goal of the optimization is to produce a shaft with the highest Eigenfrequency $W_n$ and while parameter $W_c$ is greater than the maximum required rpm of servo motor 300. This will then place this frequency within the range of digital filter characteristics of the servo controller. For instance, the maximum rpm of servo motor 300 is 3000 so #5 was the best shaft because frequency $W_n$ is the highest value subject to parameter $W_c$ being greater than 3000.

As an embodiment, the following mathematics can be used to produce shaft 32 made from 7055-T651 aluminum, which can turn up to 3000 rpm, and will have high torsional rigidity required for high performance servo loop control. The design will ensure that effective use of digital filtering can be ensured to further enhance servo loop control and minimize trajectory error. Shaft 32 will have torsional free modes of oscillation of at least 900 Hz.

The servo motor would connect to the left hand, driven end of shaft 32 and the idle end of shaft 32 is on the right. The outer diameter OD is in the range of 1.46 to 2 inches, and length L is in the range of 36 to 42 inches. Lengths L, L1, L2, L3 and inside diameters ID1, ID2, ID3 are computed using the following relationships when using Aluminum alloys:

$$L=29.76\sqrt{OD} \quad \text{eq. 1}$$

$$L3=L/2.618 \quad \text{eq. 21}$$

$$L2=L3/1.618 \quad \text{eq. 3}$$

$$L1=L2/1.618 \quad \text{eq. 4}$$

$$ID1=13/14\ OD \quad \text{eq. 5}$$

$$ID2=ID1/1.618 \quad \text{eq. 6}$$

$$ID3=ID2/1.618 \quad \text{eq. 7}$$

When using equation 1, if length L is longer than required, length L can be shortened to fit so long as it falls into the range of length L.

Shaft 32 can be made of other materials and can be made of composite materials to further enhance shaft performance. When materials other than 7075-T651 aluminum are considered, a new set of equations will result which take into account the new materials properties. Composite materials can be used to lower the rotational inertia of the idle end of shaft 32 which would contribute to lower torsional energy there. A material with higher torsional rigidity can be used on the driven end of shaft 32 to bring the free mode torsion frequency up higher. Again, a model based design method would be used to develop new design method equations (1-7) based upon the new material selection.

The performance of the electro-mechanical system can also be improved by introduction of materials which adhere to the inside and/or outside of shaft 32, in locations of concern or over the entire shaft 32. Material of consideration may be the Superelastic NiTi-Alloy known as shape memory alloys (SMA). These alloys can be used to induce high dampening of the torsional oscillations, thus allowing increase of the servo loop gains and improvement of the trajectory error of the system.

Rotary cutter 30 eliminates deficiencies of previous cutter shafts when cutting film at speeds to 150 cuts per minute. Slower speed applications allow for the cutting of film without tension and eliminate the need for the second nip roller and vacuum table. This is achieved by increasing the knife shaft acceleration rate to sever the film. However, without tension, a serrated edge support deck is used to ensure the knife tips will puncture the film when cutting. For mid-speed cycle rates, the film is cut under tension with the use of a second nip roller. This allows the knife shaft acceleration rate to be decreased and a simpler, straight edge support deck to be used. Under tension, the film snap back after severing can cause dog ears. Dog ears form when the film corners are folded back and permanently press by the second nip roller. In addition, ticks are created by notches in the knife that ensure film transfer to the second nip roller. To help reduce dog ears, custom notched knives are used to apply a tick as close to the outside edge of the film as possible. However, even this attempt does not totally eliminate the dog ear problem. In high-speed applications using rotary cutter 30 and vacuum table 18, the serrated support deck and second nip roller are eliminated and a conventional knife and straight edge support deck can be used. This eliminates the dog ears and film ticks. Vacuum table 18 creates sufficient vacuum pressure to act similar to a second nip roller. Rotary cutter 30 increased knife rotation rate to sever the film without the need of a serrated support deck.

Rotary cutter 30 eliminates common challenges faced when cutting film at high speed along with reducing manufacturing costs by the removal of parts that are required for cutter knives to operate at lower speeds. Rotary cutter 30 is rotatable using bearings at each end and is actuated by a closed loop servo controller. Shafts used in other industries may rotate through the use of pistons, chains, and belts and use multiple bearings attached throughout the length of the shaft to maintain rigidity so the shaft doesn't encounter the jump rope effect. Beginning at 0 rpm, rotary cutter 30 rotates intermittently at one revolution and then, stops at speeds that are faster than the blink of an eye.

Without this speed, the film would not cut. Other industries such as engine builders for instance develop shafts which provide their intended function each revolution while rotating continuously. The cutter shaft provides its function during one revolution, but must start and stop each cycle. The cutter is an electro-mechanical system and must be designed as such. The cutter shaft must have geometry such that when indexed in a highly dynamic way the resulting dynamic torque response at the servo falls within the capability of controls to provide servo loop stability. The torque response must be of high enough frequency that digital filters can be effectively deployed to ensure loop stability yet not degrade the ability to follow the commanded trajectory. The shaft must also have geometry such that it will not show signs of lateral vibration resulting from critical shaft resonances throughout the required commanded motion. A shape memory alloy is used to form shaft 32 to assist with pulling shaft 32 back into shape after rotation and dampen the oscillations. Shaft 32 can also be made of many types of metals or composite materials to further enhance shaft performance. When materials are considered, a model based design method is used to develop method equations to take into account the material properties. Rotary cutter 30 includes a three step bore design but it is not limited to a three step bore. Additional bores can be added to improve the design even further but at the expense of greater manufacturing cost. Adding additional bores will also result in additional design equations and new coefficients.

Now that the basic construction of apparatus 10 has been explained, the operation and some of the advantages of apparatus 10 as well as its utilization in the production of shrink-wrap packaging for a product can be explained and appreciated. Specifically, a web of film 20 moves from a supply roll through dancer bars and around idler roller 26 to the nip between rollers 12 and 13. From rollers 12 and 13, film 20 extends over deck 28 to second surface 106 and top conveying surface 100. Film 20 is under tension in the portion of its path between pinch rollers 12 and 13 and second surface 106. Rotary cutter 30 is in a rotational position with knife 36 not engaging film 20 until the leading edge of film 20 is spaced a desired distance from rotary cutter 30. At that time, rotary cutter 30 is rotated, and film 20 is cut when knife 36 passes deck 28 to define a trailing edge upstream of cut 60 and a leading edge downstream of cut 60. As the film 20 is being cut, the amount of vacuum to vacuum chamber 120 is at the maximum amount of pressure to tightly hold film 20 to belts 160 while cutting. It can then be appreciated that film 20 is held taut between second surface 106 and pinch rollers 12 and 13 during cutting. Thus, the second set of pinch rollers such as in U.S. Pat. Nos. 5,771,662 and 7,032,360 have been eliminated from apparatus 10 as film 20 is tensioned between pinch rollers 12 and 13 and vacuum table 18 when rotary cutter 30 is rotated to cut film 20.

It should be appreciated that film 20 is tightly held to belts 160 due to vacuum forces. Specifically, air is drawn from vacuum chamber 120 and compartment 139, with air flowing through air apertures 108 and 128 from between belts 166 and from between belts 166 and film 20 due to the provisions for fluid communication between belts 166 and film 20. Thus, the single sheet of film 20 including the trailing edge of cut 60 will move with belts 166 upon vacuum table 18.

After deck 28, the leading edge downstream of cut 60 will tend to follow knife 36 downwardly towards catch deck 29. Continued rotation of shaft 32 will result in knife 36 having increased spacing from catch deck 29 and film 20. However, the leading edge of cut 60 of film 20 will travel unto belts 166 extending over surface 104. Once reaching belts 166, film 20 will be tightly held to belts 166 moving from surface 104 to surface 106. It should be appreciated that the leading edge of film 20 guided onto belts 166 does not have a tendency to fold back such as the corners but will remain in a planar condition upon belts 166. Catch deck 29 acts as a loose film stopper guide if the leading edge is not located on vacuum table 18 in the event apparatus 10 is turned off and/or loss of vacuum in table 18.

It should be appreciated that sidewalls 110, guides 118 and fingers 174 act as guides for belts 166 to insure they continuously track between end rollers 168, 170. Furthermore, sidewalls 110 with recesses 112 restrict the volume of the space for air to travel to prevent film 20 from being sucked down in the spacing between belts 166 and to increase the vacuum force holding film 20 to belts 166 when passing over introduction section 102.

After leading edge of film 20 has moved sufficiently over top conveying surface 100, the amount of vacuum to vacuum chamber 120 can be decreased, even to be substantially non-existent, with film 20 being tightly held by belts 166 located over vacuum chamber 139*a*.

It should be appreciated that apparatus 10 can be utilized to cut film 20 of various widths, with film 20 of lesser widths extending over fewer belts 166 than film 20 of greater widths. To prevent air flow into air apertures 128 located outwardly of film 20, wheel 148 can be manually rotated in the form shown to move first and second adjustment plates 130 so that adjustment apertures 138 are aligned with air apertures 128 corresponding to the width of film 20 and so that adjustment apertures 138 are misaligned with and adjustment plates 130 extend across and block air apertures 128 located outwardly of the width of film 20. Thus, apparatus 10 can be easily adjusted to correspond to the width of film 20 being cut.

It should be appreciated that apparatus 10 can be utilized to correspond to the length of film 20 between the leading and trailing edges. Specifically, in the form shown, wheel 160 can be manually rotated to move adjustment partition 156 to abut with cross member 132 corresponding to the cut length of film 20. Thus, apparatus 10 can easily adjust the location where the constant vacuum zone of vacuum chamber 139*a* of vacuum table 18 ends and where vacuum chamber 139*b* begins corresponding to the location of adjustment wall 156. To allow ease of removal of film 20 from vacuum table 18 such as by a wrapping wand, the amount of vacuum in vacuum chamber 139*b* can be decreased, even to be substantially non-existent, after film 20 has passed beyond vacuum chamber 139*a*.

Although apparatus 10 and the shrink-wrap packaging produced thereby includes several unique features and is believed to produce synergistic results, it should be realized that such features can be utilized individually or in other combinations. As an example, apparatus 10 could be formed without providing adjustment for film width and/or film length. Likewise, apparatus 10 could be formed providing adjustment for film width and/or film length but utilizing other techniques for cutting and/or placing the cut film 20 upon vacuum table 18 such as by use of tie strips. Likewise, although vacuum table 18 in the form shown includes vacuum chambers 120, 139*a* and 139*b* having operationally different amounts of vacuums, features would be applicable to vacuum tables with different numbers of vacuum chambers including, but not limited to, a single vacuum chamber. Similarly, fluid communication between the carrier and the element being conveyed can be performed in other manners such as by providing holes through one or more belts if the synergistic results are not desired.

Thus since other specific forms may be embodied without departing from the spirit or general characteristics of the detailed description, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A vacuum table comprising, in combination:

a vacuum chamber having a top conveying surface including a plurality of air apertures formed therein;

a carrier moving over the top conveying surface in a conveying direction, with the carrier including an upper surface for abutment with an element to be conveyed and a lower surface for abutment with the top conveying surface, with the carrier providing air communication between the element and the vacuum chamber through the plurality of air apertures with the carrier comprising a plurality of belts moving in the conveying direction; and an adjustment plate adjustably positioned in an adjustment direction perpendicular to the conveying direction, with the adjustment plate blocking some of the plurality of air apertures of the top conveying surface, with the belts having a spacing in the adjustment direction, with the plurality of air apertures aligned with the spacings of the plurality of belts, with the plurality of belts providing air communication between the upper surface and the element.

2. The vacuum table of claim 1 with the plurality of belts being of a saw tooth style in the conveying direction.

3. The vacuum table of claim 2 further comprising, in combination: sidewalls located in the spacings between adjacent belts of the plurality of belts, with the sidewalls having a height generally equal to a distance between the upper and lower surfaces of the carrier, with each air aperture having an extent in the adjustment direction greater than the sidewall.

4. The vacuum table of claim 3 with the sidewalls extending over the air apertures, with the sidewalls including first and second recesses extending from opposite sides of each sidewall in the adjustment direction, with one of the air apertures aligned with the first and second recesses.

5. The vacuum table of claim 4 with the adjustment plate including adjustment apertures, with adjustment of the adjustment plate in the adjustment direction causing the adjustment apertures to be aligned or misaligned with the air apertures of the top conveying surface.

6. The vacuum table of claim 5 with the adjustment apertures having a length parallel to the adjustment direction, with the plurality of adjustment apertures arranged in a series of increasing lengths in the adjustment direction.

7. The vacuum table of claim 1 with the adjustment plate having a thickness, with the vacuum chamber including first and second cross members extending in the adjustment direction, with each of the first and second cross members having a depression of a depth generally equal to the thickness of adjustment plate, with the depression including a protrusion, with the adjustment plate including first and second parallel slots extending parallel to the adjustment direction, with the slots receiving and being elongated relative to the protrusions of the first and second cross members.

8. The vacuum table of claim 7 further comprising, in combination: a shaft rotatable about an axis parallel to the adjustment direction; and a block in gearing relation to the shaft and fixed to the adjustment plate.

9. The vacuum table of claim 1 further comprising, in combination: another adjustment plate adjustably positioned in the adjustment direction, with the adjustment plates being spaced from each other in the adjustment direction.

10. The vacuum table of claim 9 with the top conveying surface being intermediate the carrier and the adjustment plate.

11. Vacuum table comprising, in combination:

a vacuum chamber having a top conveying surface including a plurality of air apertures formed therein;

a carrier moving over the top conveying surface in a conveying direction, with the carrier including an upper surface for abutment with an element to be conveyed and a lower surface for abutment with the top conveying surface, with the carrier providing air communication between the element and the vacuum chamber through the plurality of air apertures;

an adjustment plate slideable beneath and parallel to the top conveying surface to be adjustably positioned in an adjustment direction perpendicular to the conveying direction, with the adjustment plate including adjustment apertures, with adjustment of the adjustment plate in the adjustment direction causing the adjustment apertures to be aligned or misaligned with the air apertures of the top conveying surface and blocking some of the plurality of air apertures of the top conveying surface;

a shaft rotatable about an axis parallel to the adjustment direction; and a block in gearing relation to the shaft and fixed to the adjustment plate.

12. The vacuum table of claim 11 further comprising, in combination: another adjustment plate adjustably positioned in the adjustment direction, with the adjustment plates being spaced from each other in the adjustment direction.

13. The vacuum table of claim 12 with the top conveying surface being intermediate the carrier and the adjustment plate.

14. The vacuum table of claim 1 with the adjustment apertures having a length parallel to the adjustment direction, with the plurality of adjustment apertures arranged in a series of increasing lengths in the adjustment direction.

15. Vacuum table including a first vacuum chamber having a conveying surface including a plurality of air apertures formed therein, a second vacuum chamber having a conveying surface including a plurality of air apertures formed therein, with an amount of vacuum being operationally different in the first and second vacuum chambers, and a carrier moving over the conveying surface of the first vacuum chamber in a conveying direction, with the carrier including an upper surface for abutment with an element to be conveyed and a lower surface for abutment with the conveying surface of the first vacuum chamber, with the carrier providing air communication between the element and the first vacuum chamber through the plurality of air apertures, wherein the carrier moves from the first vacuum chamber in the conveying direction over the conveying surface of the second vacuum chamber, with the carrier providing air communication between the element and the second vacuum chamber through the plurality of air apertures.

16. The vacuum table of claim 15 further comprising, in combination: a compartment; and an adjustment partition in the compartment dividing the compartment into the first and second vacuum chambers, with the adjustment partition adjustable in the conveying direction to vary extents of the first and second vacuum chambers parallel to the conveying direction.

17. The vacuum table of claim 16 wherein the amount of vacuum in the first vacuum chamber is constant and in the second vacuum chamber is variable.

18. The vacuum table of claim 17 further comprising, in combination: a shaft rotatable about an axis parallel to the conveying direction, with the adjustment partition in gearing relation to the shaft.

19. The vacuum table of claim 18 with the compartment further including a plurality of cross members extending perpendicular to the conveying direction, with the adjustment partition being adjustable to abut with one of the plurality of cross members to divide the compartment into the first and second vacuum chambers.

20. The vacuum table of claim 19 further comprising, in combination: an adjustment plate adjustably positioned in an adjustment direction perpendicular to the conveying direction, with the adjustment plate blocking some of the plurality of air apertures of the conveying surfaces of the first and second vacuum chambers, with the conveying surfaces being intermediate the carrier and the adjustment plate, with the adjustable plate being slideable relative to the plurality of cross members.

21. The vacuum table of claim 19 further comprising, in combination: an introduction vacuum chamber with the first vacuum chamber located intermediate the introduction vacuum chamber and the second vacuum chamber, with the amount of vacuum being operationally different in the introduction, first and second vacuum chambers, with the introduction vacuum chamber including a conveying surface, with the carrier moving over the conveying surface of the introduction vacuum chamber, with the amount of vacuum in the introduction chamber being variable and having a maximum amount of vacuum greater than the amount of vacuum in the first vacuum chamber.

22. The vacuum table of claim 21 wherein the conveying surface of the introduction vacuum chamber comprises a first surface and a second surface arranged at an obtuse angle, with the second surface extending linearly with the conveying surface of the first vacuum chamber.

23. The vacuum table of claim 22 with the carrier comprising a plurality of belts moving in the conveying direction, with the belts having a spacing in the adjustment direction, with the plurality of air apertures aligned with the spacings of the plurality of belts, with the plurality of belts providing air communication between the upper surface and the element.

24. The vacuum table of claim 23 wherein the introduction section further comprises, in combination: sidewalls located in the spacings between adjacent belts of the plurality of belts, with the sidewalls having a height generally equal to a distance between the upper and lower surfaces of the carrier, with each air aperture having an extent in the adjustment direction greater than the sidewall.

25. The vacuum table of claim 15 wherein the amount of vacuum in the second vacuum chamber is constant and in the first vacuum chamber is variable.

26. The vacuum table of claim 25 wherein the amount of vacuum in the first vacuum chamber has a maximum amount of vacuum greater than the amount of vacuum in the second vacuum chamber.

27. The vacuum table of claim 26 wherein the conveying surface of the first vacuum chamber comprises a first surface and a second surface arranged at an obtuse angle, with the second surface extending linearly with the conveying surface of the second vacuum chamber.

28. The vacuum table of claim 27 with the carrier comprising a plurality of belts moving in the conveying direction, with the belts having a spacing in the adjustment direction, with the plurality of air apertures aligned with the spacings of the plurality of belts, with the plurality of belts providing air communication between the upper surface and the element.

29. The vacuum table of claim 28 wherein the first vacuum chamber further comprises, in combination: sidewalls located in the spacings between adjacent belts of the plurality of belts, with the sidewalls having a height generally equal to a distance between the upper and lower surfaces of the carrier, with each air aperture having an extent in the adjustment direction greater than the sidewall.

30. The vacuum table of claim 29 further comprising, in combination: a pair of pinch rollers, with a plane tangent to an abutment of the pair of pinch rollers lying generally in a same plane as the conveying surface of the second vacuum chamber; and a rotary cutter positioned between the pair of pinch rollers and the second vacuum chamber, with the amount of vacuum of the first vacuum chamber being at the maximum amount of vacuum when the rotary cutter is rotated.

31. Vacuum table comprising, in combination:

a vacuum chamber having a top conveying surface including a plurality of air apertures formed therein;

a carrier moving over the top conveying surface in a conveying direction, with the carrier including an upper surface for abutment with an element to be conveyed and a lower surface for abutment with the top conveying surface, with the carrier providing air communication between the element and the vacuum chamber through the plurality of air apertures; and an adjustment plate slideable beneath and parallel to the top conveying surface to be adjustably positioned in an adjustment direction perpendicular to the conveying direction, with the adjustment plate including adjustment apertures, with adjustment of the adjustment plate in the adjustment direction causing the adjustment apertures to be aligned or misaligned with the air apertures of the top conveying surface and blocking some of the plurality of air apertures of the top conveying surface, with the adjustment plate having a thickness, with the vacuum chamber including first and second cross members extending in the adjustment direction, with each of the first and second cross members having a depression of a depth generally equal to the thickness of adjustment plate, with the depression including a protrusion, with the adjustment plate including first and second parallel slots extending parallel to the adjustment direction, with the slots receiving and being elongated relative to the protrusions of the first and second cross members.

32. The vacuum table of claim 31 further comprising, in combination: a shaft rotatable about an axis parallel to the adjustment direction; and a block in gearing relation to the shaft and fixed to the adjustment plate.

* * * * *